US010288014B2

(12) United States Patent
Kuske et al.

(10) Patent No.: US 10,288,014 B2
(45) Date of Patent: May 14, 2019

(54) INTERNAL COMBUSTION ENGINE WITH EXHAUST-GAS RECIRCULATION ARRANGEMENT AND METHOD FOR OPERATING AN INTERNAL COMBUSTION ENGINE OF SAID TYPE

(71) Applicant: Ford Global Technologies, LLC, Dearborn, MI (US)

(72) Inventors: Andreas Kuske, Geulle (NL); Hans Guenter Quix, Herzogenrath (DE); Franz Arnd Sommerhoff, Aachen (DE); Joerg Kemmerling, Monschau (DE); Vanco Smiljanovski, Bedburg (DE); Helmut Matthias Kindl, Aachen (DE); Hanno Friederichs, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 41 days.

(21) Appl. No.: 15/721,587

(22) Filed: Sep. 29, 2017

(65) Prior Publication Data

US 2018/0094611 A1 Apr. 5, 2018

(30) Foreign Application Priority Data

Sep. 30, 2016 (DE) ..... 10 2016 219 097

(51) Int. Cl.

| | |
|---|---|
| ***F02M 26/02*** | (2016.01) |
| ***F02M 26/30*** | (2016.01) |
| ***F02M 26/25*** | (2016.01) |
| ***F02M 26/32*** | (2016.01) |
| ***F02M 26/47*** | (2016.01) |

(52) U.S. Cl.

CPC ..... *F02M 26/30* (2016.02); *F02M 26/02* (2016.02); *F02M 26/25* (2016.02); *F02M 26/32* (2016.02); *F02M 26/47* (2016.02)

(58) Field of Classification Search

CPC ..... F02M 26/02; F02M 26/25; F02M 26/30; F02M 26/32; F02M 26/47; F01N 3/0205; F01N 3/043; F01N 2390/08; F01N 2410/00; F01N 2900/1404; F01N 2900/1406; F01P 7/14; F01P 7/16; F01P 2007/146

USPC ..... 60/274, 287, 288, 605.2

See application file for complete search history.

(56) References Cited

U.S. PATENT DOCUMENTS

2014/0007575 A1* 1/2014 Ernst ..... F01K 23/065 60/618

2014/0116050 A1* 5/2014 Seo ..... F01K 23/065 60/659

(Continued)

*Primary Examiner* — Mark A Laurenzi

*Assistant Examiner* — Dapinder Singh

(74) *Attorney, Agent, or Firm* — Julia Voutyras; McCoy Russell LLP

(57) ABSTRACT

A method for operating an internal combustion engine is provided. The method includes closing an EGR valve positioned in an exhaust gas recirculation (EGR) conduit downstream of an EGR cooler, the EGR conduit coupled to an intake system and an exhaust system and determining a profile of exhaust pressure waves in the exhaust system. The method also includes adjusting a volume of variable volume vessel based on the profile of the exhaust pressure waves, the variable volume vessel positioned downstream of the EGR cooler and upstream of the EGR valve.

20 Claims, 2 Drawing Sheets

(56) References Cited

U.S. PATENT DOCUMENTS

| | | | | |
|---|---|---|---|---|
| 2016/0138430 | A1* | 5/2016 | Son | F01K 23/10<br>60/618 |
| 2016/0252055 | A1* | 9/2016 | Nair | F02M 26/16<br>123/568.12 |

* cited by examiner

INTERNAL COMBUSTION ENGINE WITH EXHAUST-GAS RECIRCULATION ARRANGEMENT AND METHOD FOR OPERATING AN INTERNAL COMBUSTION ENGINE OF SAID TYPE

CROSS REFERENCE TO RELATED APPLICATION

The present application claims priority to German Patent Application No. 102016219097.0, filed on Sep. 30, 2016. The entire contents of the above-referenced application are hereby incorporated by reference in its entirety for all purposes.

FIELD

The present description relates generally to methods and systems for exhaust gas recirculation in an internal combustion engine.

BACKGROUND/SUMMARY

In previous engines exhaust gas recirculation (EGR) systems may be employed to reduced emissions. The EGR systems typically route exhaust gas from an exhaust conduit to an intake conduit in the engine. Some EGR systems also employ EGR coolers designed to remove heat from the EGR gas to enable a greater mass of EGR gas to be introduced into the intake system, to further reduce emissions.

However, EGR systems may be shut-down during certain periods of engine operation, such as during start-up (e.g., cold start). Consequently, the EGR cooler may remain unused during these periods of EGR inactivity. However, it may be desirable to extract heat from exhaust gas during such time periods. Thus, previous EGR systems may not efficiently operate the EGR cooler during certain operating conditions, thereby decreasing the system's efficiency.

Against the background of that stated above and recognizing the aforementioned problems the inventors have developed a method for operating an internal combustion engine. The method includes closing an EGR valve positioned in an exhaust gas recirculation (EGR) conduit downstream of an EGR cooler, the EGR conduit coupled to an intake system and an exhaust system and determining a profile of exhaust pressure waves in the exhaust system. The method also includes adjusting a volume of variable volume vessel based on the profile of the exhaust pressure waves, the variable volume vessel positioned downstream of the EGR cooler and upstream of the EGR valve. Consequently, pressure waves in the exhaust system can be leveraged to enable EGR cooler operation during periods of EGR inactivity. The energy extracted by the EGR cooler may be used to heat engine coolant and/or engine oil, for example, to increase combustion efficiency and correspondingly reduce emissions.

Specifically, in one example, the volume of the variable volume vessel may be adjusted to reinforce pressure wave propagation through the EGR cooler while the EGR valve is closed. In this manner, the variable volume vessel enables the acoustics in the EGR system to be tuned to promote and reinforce wave propagation therethrough. Consequently, the EGR cooler can extract heat from exhaust gas while the EGR valve is closed, thereby increasing engine efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
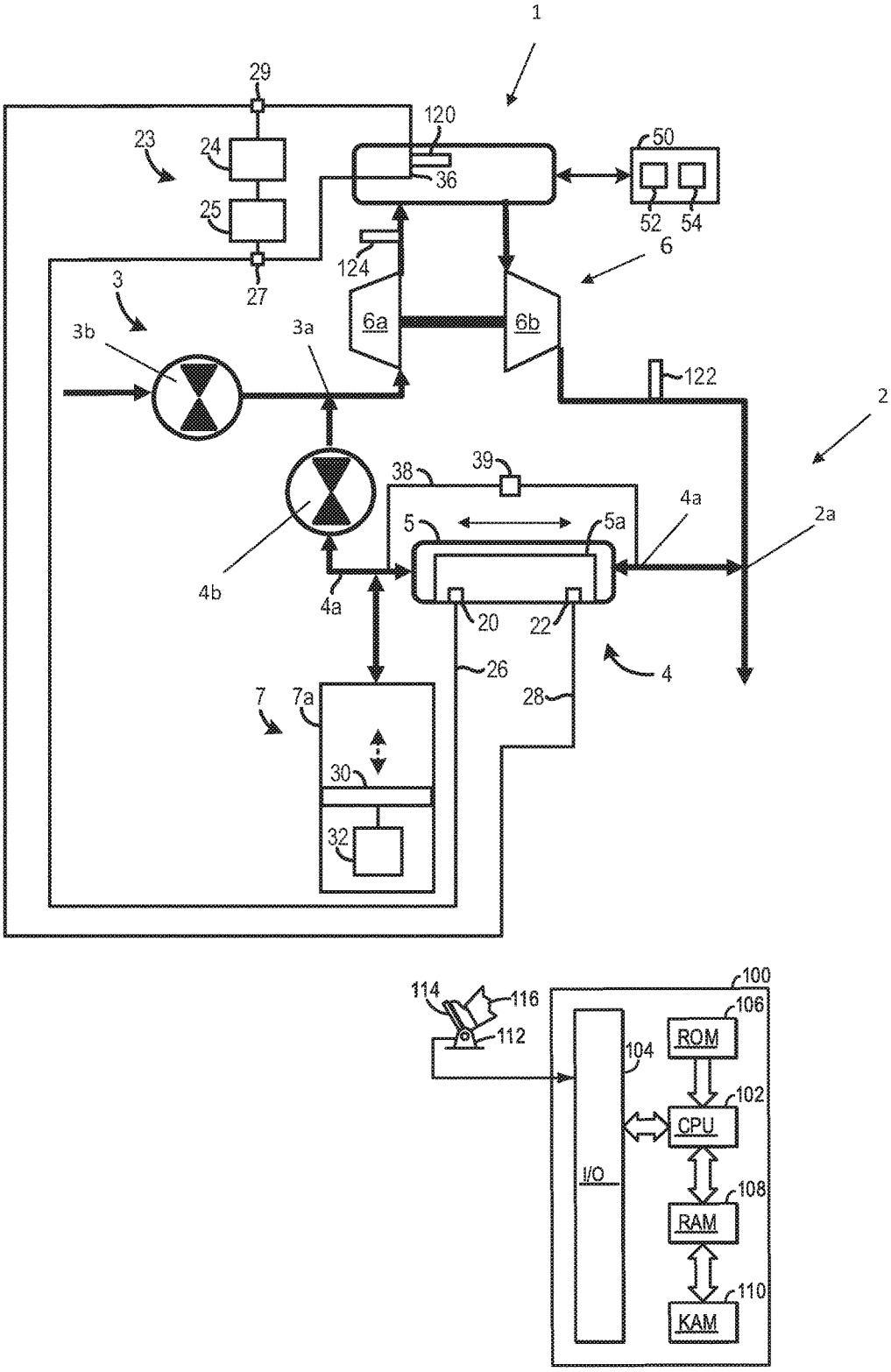
FIG. 1 schematically shows an example of an internal combustion engine together with an exhaust-gas recirculation arrangement.

An internal combustion engine is described herein. The internal combustion engine may include at least one cylinder, an intake system for supplying charge air to the at least one cylinder, an exhaust-gas discharge system for discharging the exhaust gases, and an exhaust-gas recirculation arrangement which includes a recirculation line that branches off from the exhaust-gas discharge system so as to form a first junction point and opens into the intake system so as to form a second junction point, a cooler being provided in the recirculation line. The cooler has a coolant jacket which conducts coolant and which serves for the transfer of heat between the exhaust gas and the coolant, and a shut-off element being arranged in the recirculation line downstream of the cooler.

A method for operating an internal combustion engine of said type is also described herein.

An internal combustion engine of the stated type may be used as a motor vehicle drive unit. Within the context of the present description, the expression "internal combustion engine" encompasses diesel engines and Otto-cycle engines and also hybrid internal combustion engines, which utilize a hybrid combustion process, and hybrid drives which include not only the internal combustion engine but also an electric machine which can be connected in terms of drive to the internal combustion engine and which captures power from the internal combustion engine or which, as a switchable auxiliary drive, additionally outputs power.

In the development of internal combustion engines, it may be sought to reduce (e.g., minimize) fuel consumption. Furthermore, a reduction of the pollutant emissions is sought in order to be able to comply with current and future pollutant emissions requirements.

Internal combustion engines may also be equipped with a supercharging arrangement, wherein supercharging is primarily a method for increasing power, in which the charge air required for the combustion process in the engine is compressed, as a result of which a greater mass of charge air can be supplied to each cylinder per working cycle. In this way, the fuel mass and therefore the mean pressure in the cylinder can be increased.

Supercharging may be a suitable way for increasing the power of an internal combustion engine while maintaining an unchanged swept volume, or for reducing the swept volume while maintaining the same power. In any case, supercharging leads to an increase in volumetric power output and a more expedient power-to-weight ratio. If the swept volume is reduced, it is possible, given the same vehicle boundary conditions, to shift the load collective toward higher loads, at which the specific fuel consumption is lower. Supercharging of an internal combustion engine consequently assists in the efforts to reduce engine fuel consumption and therefore improve the efficiency of the internal combustion engine.

Using a suitable transmission configuration, it is additionally possible to realize so-called downspeeding, whereby a lower specific fuel consumption is likewise achieved. In the case of downspeeding, use is made of the fact that the specific fuel consumption at low engine speeds is generally lower, in particular in the presence of relatively high loads.

When engines utilize supercharging, it is also possible to achieve advantages with regard to exhaust-gas emissions. With suitable supercharging for example of a diesel engine, the nitrogen oxide emissions can therefore be reduced without a significant loss in efficiency. At the same time, the hydrocarbon emissions may be positively influenced when engines use superchargers. The emissions of carbon dioxide, which correlate directly with fuel consumption, likewise decrease with falling fuel consumption.

To adhere to current and future pollutant emissions requirements, however, further measures may be necessary. Here, the focus of engine development is on inter alia the reduction of nitrogen oxide emissions, which are of high relevance, in particular in diesel engines. Since the formation of nitrogen oxides requires not only an excess of air but also high temperatures, one concept for lowering the nitrogen oxide emissions may include the implementation of combustion processes with lower combustion temperatures.

Here, exhaust-gas recirculation (EGR), that is to say the recirculation of combustion gases from an outlet side to an inlet side of an engine, may be expedient in achieving this aim, wherein it is possible for the nitrogen oxide emissions to be considerably reduced with increasing exhaust-gas recirculation rate. Here, the exhaust-gas recirculation rate $x_{EGR}$ may be determined as $x_{EGR}=m_{EGR}/(m_{EGR}+m_{fresh\ air})$, where $m_{EGR}$ denotes the mass of recirculated exhaust gas and $m_{fresh\ air}$ denotes the supplied fresh air. The oxygen provided via exhaust-gas recirculation may also be taken into consideration.

To obtain a considerable reduction in nitrogen oxide emissions, high exhaust-gas recirculation rates may be needed, which may be of an order of magnitude of $x_{EGR}\approx 60\%$ to 70% or more. Such high recirculation rates may require cooling of the recirculated exhaust gas. Cooling the recirculated gas reduces the exhaust gas temperature and increasing the density of the exhaust gas, so that a greater mass of exhaust gas can be recirculated. Consequently, exhaust-gas recirculation arrangements may be equipped with a cooler. The exhaust-gas recirculation arrangement of the internal combustion engine described herein may also have a cooler arranged in the recirculation line, that is to say an EGR cooler, which has a coolant-conducting coolant jacket configured to transfer of heat between exhaust gas and coolant.

Problems can arise during the introduction of the recirculated exhaust gas into the intake system if the temperature of the recirculated hot exhaust gas decreases and condensate forms.

Firstly, condensate may form if the recirculated hot exhaust gas meets, and is mixed with, cool fresh air in the intake system. In such an example, the exhaust gas cools down, whereas the temperature of the fresh air is increased. The temperature of the mixture of fresh air and recirculated exhaust gas, that is to say the temperature of the combustion air, lies below the exhaust-gas temperature of the recirculated exhaust gas. During the course of the cooling of the exhaust gas, liquids previously contained in the exhaust gas and/or in the combustion air still in gaseous form, in particular water, may condense if the dew point temperature of a component of the gaseous combustion-air flow is undershot. Condensate formation occurs in the free combustion-air flow, wherein contaminants in the combustion air often form the starting point for the formation of condensate droplets.

Secondly, condensate may form when the recirculated hot exhaust gas and/or the combustion air impinges on the internal wall of the intake system, as the wall temperature generally lies below the dew point temperature of the relevant gaseous components.

Condensate and condensate droplets may be undesirable and may lead to increased noise emissions in the intake system and possibly to damage of the impeller blades of a compressor impeller, which is arranged in the intake system, of a supercharger or of an exhaust-gas turbocharger. The latter effect is associated with a reduction in efficiency of the compressor.

With regard to the problem of the above-described condensate formation, an EGR cooler may be helpful in reducing condensation. The cooling of the exhaust gas for recirculation during the course of the recirculation has the advantageous effect reducing (e.g., substantially inhibiting) condensation formation in the intake system. Rather, the condensation formation may take place in the exhaust gas recirculation system where the condensate may be removed from the system.

A disadvantage of prior EGR coolers is that the exhaust-gas energy, that is to say the heat that can be extracted from the exhaust gas in the cooler by means of coolant, is only available and usable when exhaust gas is being recirculated. According to the prior art, if the exhaust-gas recirculation arrangement has been deactivated, such that no exhaust gas is being recirculated, the exhaust-gas energy of the hot exhaust gas remains unutilized. Further efficiency advantages in the internal combustion engine could be achieved if said exhaust-gas energy could be utilized.

The energy of the hot exhaust gas could, for example, be utilized to reduce friction losses and thus the fuel consumption of the internal combustion engine. In such an example, rapid warming of the engine oil by means of exhaust-gas heat, in particular after a cold start, may be expedient. Fast warming of the engine oil during the warm-up phase of the internal combustion engine may ensure a correspondingly fast decrease in the viscosity of the oil and thus a reduction in friction and friction losses, in particular in the bearings which are supplied with oil, for example the bearings of the crankshaft.

Here, the oil may, for example, be actively warmed by means of a heating device. For this purpose, it may be possible in the warm-up phase for a coolant-operated oil cooler to be utilized, contrary to its intended purpose, for warming the oil.

Fast warming of the engine oil in order to reduce friction losses may also be aided by the fast heating of the internal combustion engine itself, which in turn is assisted, that is to say forced, by virtue of the small amount of heat being extracted from the internal combustion engine during the warm-up phase.

In this respect, in the case of a liquid-cooled internal combustion engine, it may also be expedient for heat to be supplied to the coolant of the engine cooling system, in particular in the warm-up phase or after a cold start. It would be possible for the exhaust-gas energy to be utilized for warming the coolant for the engine cooling.

Against the background of that stated above, it is an objective of the internal combustion engine described herein to utilize the exhaust-gas energy more effectively than in the prior art, to achieve increased efficiency.

A method for operating an internal combustion engine of said type is also described herein that enable the engine to achieve efficiency gains.

In one example, the efficiency gains may be achieved by an internal combustion engine having at least one cylinder, an intake system for supplying charge air to the at least one cylinder, an exhaust-gas discharge system for discharging the exhaust gases, and an exhaust-gas recirculation arrangement which includes a recirculation line that branches off from the exhaust-gas discharge system so as to form a first junction point and opens into the intake system so as to form a second junction point, a cooler being provided in the recirculation line. The cooler has a coolant jacket which conducts coolant and which serves for the transfer of heat between the exhaust gas and the coolant, and a shut-off element being arranged in the recirculation line downstream of the cooler. The internal combustion engine may be distinguished by the fact that a volume is provided for the exhaust gas between the first junction point and the shut-off element of the exhaust-gas recirculation arrangement is variable, said volume being of coherent form and being open toward the exhaust-gas discharge system.

In the case of the internal combustion engine described above, the dynamic wave phenomena that occur in the exhaust-gas discharge system, in particular during the charge exchange, are utilized for improving the heat transfer in the EGR cooler, specifically in particular when the exhaust-gas recirculation arrangement has been deactivated and no exhaust gas is being recirculated.

The evacuation of the combustion gases out of a cylinder of the internal combustion engine during the charge exchange may be based substantially on two different mechanisms. When the outlet valve opens close to bottom dead center at the start of the charge exchange, the combustion gases flow at high speed through the outlet opening into the exhaust-gas discharge system on account of the high pressure level prevailing in the cylinder toward the end of the combustion and the associated high pressure difference between combustion chamber and exhaust line. Said pressure-driven flow process is assisted by a high pressure peak which is also referred to as a pre-outlet shock and which propagates along the exhaust-gas discharge system at the speed of sound. The pressure of the exhaust gas is dissipated, that is to say reduced, to a greater or lesser extent via an increase or decrease in the distance traveled by the exhaust gas, as result of friction. During the further course of the charge exchange, the pressures in the cylinder and in the exhaust-gas discharge system are equalized, such that the combustion gases are no longer evacuated primarily in a pressure-driven manner but rather are expelled as a result of the reciprocating movement of the piston.

To be able to utilize the dynamic wave phenomena occurring in the exhaust-gas discharge system, in particular the pressure peaks, for improving the heat transfer in the EGR cooler, the exhaust-gas recirculation arrangement described herein, by means of the arrangement of the shut-off element downstream of the cooler, may be configured to open toward the exhaust-gas discharge system, such that the cooler can by impinged on with hot exhaust gas even when the shut-off element is closed. The pressure wave passing along the exhaust-gas discharge system then propagates, even when the shut-off element is closed, that is to say when the exhaust-gas recirculation arrangement has been deactivated, into the recirculation line or the exhaust-gas recirculation arrangement and into the cooler.

A pressure peak entering the recirculation line at the first junction point may propagate in the recirculation line or in the exhaust-gas recirculation arrangement and compresses the exhaust gas situated between the first junction point and the closed shut-off element, whereby hot exhaust gas is conveyed through the cooler and releases heat to the coolant by convection. The pressure wave passing along the recirculation line is reflected on the closed end of the exhaust-gas recirculation arrangement, wherein the exhaust gas situated between the closed shut-off element and the first junction point is expanded again, whereby the exhaust gas is conveyed through the cooler for a second time and releases heat to the coolant by convection again.

It must also be noted that the temperature of the exhaust gas is locally and temporarily increased owing to the propagating pressure peak. The increased exhaust-gas temperature, or the increased temperature difference between the exhaust gas and the coolant resulting from the increased exhaust-gas temperature, gives rise to an intensified heat transfer by heat conduction.

As described herein, the exhaust-gas volume between the first junction point and the shut-off element of the exhaust-gas recirculation arrangement is variable, that is to say changeable or adjustable. This concrete or structural feature has the advantageous effect that the coherent volume, which is open toward the exhaust-gas discharge system, can be adapted to different operating states of the internal combustion engine, in such a way that the volume is set (e.g., optimized) with regard to the dynamic wave phenomena occurring in the exhaust-gas discharge system in order to increase (e.g., maximize) the heat transfer in the EGR cooler. In one example, both the propagation and the sustainment and also the reflection of the pressure wave in the volume may be taken into account when adjusting the volume in the EGR system.

The exhaust-gas energy can be utilized for example in the warm-up phase or after a cold start for warming the engine oil of the internal combustion engine and thus reducing the friction losses of the internal combustion engine. In the case of a liquid-cooled internal combustion engine, the exhaust-gas energy can be utilized for warming the coolant of the engine cooling system and thus accelerating the heating of the internal combustion engine. Both measures improve or increase the efficiency of the internal combustion engine.

It must also be taken into consideration in this context that, after a cold start in previous internal combustion engines, no exhaust gas is recirculated, because, upon the introduction of the recirculated exhaust gas into the cold intake system, a particularly large amount of condensate would inevitably form. Consequently, the exhaust-gas energy of the hot exhaust gas cannot be utilized in particular after a cold start, despite the fact that a demand for warming the engine oil and the internal combustion engine in targeted fashion exists, specifically after a cold start of the internal combustion engine.

In contrast, in the internal combustion engine described herein, the exhaust-gas energy of the hot exhaust gas can be utilized even when the exhaust-gas recirculation arrangement has been deactivated (e.g., when the shut-off element in the exhaust-gas recirculation arrangement is closed). Heat can be transferred from the exhaust gas to the coolant of the cooler even when the exhaust-gas recirculation arrangement has been deactivated, wherein the coolant flowing or circulating through the cooler discharges the heat from the interior of the cooler and supplies it for a predefinable use. As a result, the efficiency of the internal combustion engine is increased. In this respect, according to the prior art, the exhaust-gas energy inherent in the exhaust gas of the exhaust-gas discharge system cannot be utilized, but according to the engine described herein, said exhaust-gas energy can be utilized.

The internal combustion engine described herein achieves efficiency gains and specifically uses exhaust-gas energy more effectively than previous engines.

The shut-off element functions as an EGR valve and, when the exhaust-gas recirculation arrangement is active, serves for the adjustment of the recirculation rate, that is to say of the recirculated exhaust-gas flow rate. The use of a combination valve arranged at the second junction point permits adjustment of the recirculated exhaust-gas flow rate and at the same time throttling of the intake fresh-air flow rate.

Embodiments of the internal combustion engine are advantageous in which a volume provided for the exhaust gas between the cooler and the shut-off element of the exhaust-gas recirculation arrangement is variable, said volume being of coherent form and being open toward the exhaust-gas discharge system. In this embodiment, the volume downstream of the cooler may be variable, and the inlet region of the exhaust-gas recirculation arrangement upstream of the cooler may not be variable.

Embodiments of the internal combustion engine may be advantageous in which a supercharging arrangement is provided. Reference is made to the advantages already mentioned, and the statements made, in conjunction with supercharging.

Further advantageous embodiments of the internal combustion engine are discussed below.

Embodiments of the internal combustion engine may be advantageous in which the volume provided for the exhaust gas between the first junction point and the shut-off element of the exhaust-gas recirculation arrangement may include at least one vessel which is connected or connectable to the recirculation line.

To make the volume provided for the exhaust gas variable, it is possible for one vessel or multiple vessels or additional volumes that are connectable to the recirculation line to be provided. As a result of the connection of a vessel to the recirculation line, that is to say to the exhaust-gas recirculation system, the volume provided for the exhaust gas is enlarged. Through the successive connection of vessels to the recirculation line, the volume provided for the exhaust gas may be enlarged in a stepped or progressive fashion.

In this context, embodiments of the internal combustion engine may be advantageous in which the at least one vessel is itself of variable volume. The volume provided for the exhaust gas is adjusted through the variation of the volume of the vessel connected to the recirculation line.

Embodiments of the internal combustion engine may be advantageous in which the recirculation line is variable in length and thus also in volume, for example by virtue of the recirculation line being capable of being shortened and lengthened in a telescopic fashion.

Embodiments of the internal combustion engine are advantageous in which at least one compressor which can be driven by means of an auxiliary drive is arranged in the intake system.

The advantage of a compressor that can be driven by means of an auxiliary drive, that is to say a supercharger, in relation to an exhaust-gas turbocharger is that the supercharger can generate, and make available, the desired charge pressure over a wider range of operating conditions. Specifically, in one example, a compressor driven by an auxiliary drive may provide boost to the engine regardless of the operating state of the internal combustion engine. This applies in particular to a supercharger which can be driven electrically by means of an electric machine, and is therefore independent of the rotational speed of the crankshaft.

In the prior art, it is specifically the case that difficulties are encountered in achieving an increase in power in all engine speed ranges by means of exhaust-gas turbocharging. A relatively severe torque drop may be observed in the event of a certain engine speed being undershot in prior engines. Said torque drop is understandable if one takes into consideration that the charge pressure ratio is dependent on the turbine pressure ratio or the turbine power. If the engine speed is reduced, a smaller exhaust-gas mass flow and therefore to a lower turbine pressure ratio or lower turbine power may be achieved. Consequently, toward lower engine speeds, the charge pressure ratio likewise decreases. The decrease in charge pressure ratio equates to a torque drop.

Embodiments of the internal combustion engine may nevertheless be advantageous in which at least one exhaust-gas turbocharger is provided, which includes a turbine arranged in the exhaust-gas discharge system and a compressor arranged in the intake system. In an exhaust-gas turbocharger, a compressor and a turbine are arranged on the same shaft. The hot exhaust-gas flow is fed to the turbine and expands in the turbine with a release of energy, and as a result the shaft is rotated. The energy supplied by the exhaust-gas flow to the shaft is used for driving the compressor which is likewise arranged on the shaft. The compressor conveys and compresses the charge air fed to it. Consequently, the compressor can provide boost to the cylinders. In one example, a charge-air cooler is advantageously provided in the intake system downstream of the compressor. The charge-air cooler enables the compressed charge air to be cooled before it enters the at least one cylinder. The charge-air cooler lowers the temperature and thereby increases the density of the charge air, such that the cooler also contributes to improved charging of the cylinders, that is to say to a greater air mass. Consequently, compression brought about by cooling of the intake air is achieved by the engine.

One advantage of an exhaust-gas turbocharger in relation to a supercharger, which can be driven by means of an auxiliary drive, is that an exhaust-gas turbocharger utilizes the exhaust-gas energy of the hot exhaust gases, whereas a supercharger draws the energy needed for driving it directly or indirectly from the internal combustion engine and thus adversely affects, that is to say reduces, the efficiency, at least for as long as the drive energy does not originate from an energy recovery source.

If the supercharger is not one that can be driven by means of an electric machine, that is to say electrically, a mechanical or kinematic connection for power transmission may be needed between the supercharger and the internal combustion engine, which may also adversely affect the packaging in the engine bay.

To be able to counteract a torque drop at low engine speeds, embodiments of the internal combustion engine may be particularly advantageous in which at least two exhaust-gas turbochargers are provided. Specifically, if the engine speed is reduced, this leads to a smaller exhaust-gas mass flow and therefore to a lower charge-pressure ratio.

Through the use of multiple exhaust-gas turbochargers, for example multiple exhaust-gas turbochargers connected in series or parallel, the torque characteristic of a supercharged internal combustion engine may be noticeably improved.

In order to improve the torque characteristic, it is possible, in addition to the at least one exhaust-gas turbocharger, for an additional compressor to also be provided, specifically either a supercharger that can be driven by means of an auxiliary drive or a compressor of a further exhaust-gas turbocharger.

Embodiments of the supercharged internal combustion engine may be advantageous in which the recirculation line opens into the intake system downstream of the compressor so as to form the second junction point.

In the case of a so-called high-pressure EGR arrangement, the exhaust gas is introduced into the intake system downstream of the compressor. To provide or ensure the pressure gradient, needed for a recirculation, between the exhaust-gas discharge system and the intake system, in the case of an exhaust-gas turbocharging arrangement the exhaust gas may be extracted from the exhaust-gas discharge system upstream of the associated turbine. High-pressure EGR has the advantage that the exhaust gas does not pass the compressor, and therefore does not have to be subjected to exhaust-gas aftertreatment, for example in a particle filter, before the recirculation. There is no risk of deposits in the compressor which change the geometry of the compressor, in particular the flow cross sections, and thereby reduce the efficiency of the compressor. Condensate formation occurs—if at all—downstream of the compressor, which also, during the course of the compression, heats the charge air that is supplied to it, and thereby counteracts (e.g., prevents) condensate formation.

Embodiments of the supercharged internal combustion engine may also be advantageous in which the recirculation line opens into the intake system upstream of the compressor so as to form the second junction point.

During the operation of an internal combustion engine with exhaust-gas turbocharging and the simultaneous use of a high-pressure EGR arrangement, a conflict may arise when the recirculated exhaust gas is extracted from the exhaust-gas discharge system upstream of the turbine and is no longer available for driving the turbine.

In the event of an increase in the exhaust-gas recirculation rate, the exhaust-gas flow introduced into the turbine simultaneously decreases. The reduced exhaust-gas mass flow through the turbine leads to a lower turbine pressure ratio, as a result of which the charge pressure ratio also falls, which equates to a smaller compressor mass flow. Aside from the decreasing charge pressure, problems may additionally arise in the operation of the compressor with regard to the surge limit. Disadvantages may also arise in terms of the pollutant emissions, for example with regard to the formation of soot during an acceleration in the case of diesel engines.

For this reason, engine features that enable both high charge pressures and high exhaust-gas recirculation rates to be achieved, may be desirable. One such engine feature that enables high charger pressures and high exhaust-gas recirculation rates to be achieved is a low-pressure EGR system. In a low pressure EGR system exhaust gas that has already flowed through the turbine is recirculated into the intake system. For this purpose, the low-pressure EGR arrangement may include a recirculation line which branches off from the exhaust-gas discharge system downstream of the turbine. The recirculation line may open into the intake system upstream of the compressor in order to be able to realize the pressure gradient, needed for a recirculation, between the exhaust-gas discharge system and the intake system.

To generate the pressure gradient, needed for recirculation, it is also possible for a shut-off element to be provided in the exhaust-gas discharge system downstream of the first junction point in order to cause a build-up of the exhaust gas and increase the exhaust-gas pressure, and/or for a shut-off element to be provided in the intake system upstream of the second junction point in order, at the inlet side, to lower the pressure upstream of the compressor. Both measures may be disadvantageous with regard to energy efficiency. In particular, the throttling of the charge air at the inlet side upstream of the compressor must be regarded as being disadvantageous with regard to the supercharging of the internal combustion engine.

The exhaust gas which is recirculated via the low-pressure EGR arrangement is mixed with fresh air upstream of the compressor. The mixture of fresh air and recirculated exhaust gas produced in this way forms the charge air which is supplied to the compressor and compressed, wherein the compressed charge air is cooled, in some examples downstream of the compressor, in a charge-air cooler.

Since exhaust gas is conducted through the compressor, the exhaust gas may be subjected to exhaust-gas aftertreatment downstream of the turbine. The low-pressure EGR arrangement may also be combined with a high-pressure EGR arrangement, in some examples.

For the reasons already stated above, embodiments of the supercharged internal combustion engine may therefore be advantageous in which the recirculation line branches off from the exhaust-gas discharge system upstream of the turbine so as to form the first junction point.

Embodiments of the supercharged internal combustion engine may also be advantageous in which the turbine of an exhaust-gas turbocharger that is provided has a variable turbine geometry, which permits more extensive adaptation to the operation of the internal combustion engine through adjustment of the turbine geometry or of the effective turbine cross section. Here, adjustable guide blades for influencing the flow direction may be arranged in the inlet region of the turbine. By contrast to the impeller blades of the rotating impeller, the guide blades do not rotate with the shaft of the turbine.

If the turbine has a fixed, invariable geometry, the guide blades are arranged in the inlet region so as to be not only stationary but also completely immovable, that is to say rigidly fixed, if a guide device is provided at all. By contrast, in the case of a variable geometry, the guide blades are duly arranged to be stationary but not completely immovable. Specifically, the guide blades may be arranged so as to be rotatable about their axis, such that the flow approaching the impeller blades can be influenced by the blades.

Through adjustment of the turbine geometry, it may be possible for the exhaust-gas pressure upstream of the turbine to be influenced, and thus for the pressure gradient between the exhaust-gas discharge system and intake system, and thus the recirculation rate of the high-pressure EGR arrangement, to be influenced.

Likewise for reasons already stated above, embodiments of the supercharged internal combustion engine may be advantageous in which the recirculation line branches off from the exhaust-gas discharge system downstream of the turbine so as to form the first junction point.

In this context, embodiments of the supercharged internal combustion engine are advantageous in which at least one exhaust-gas aftertreatment system is provided in the exhaust-gas discharge system between the turbine and the first junction point. Since exhaust gas is conducted through the compressor, the exhaust gas may be subjected to exhaust-gas aftertreatment downstream of the turbine.

In one example, embodiments of the supercharged internal combustion engine may be advantageous in which a particle filter is provided in an exhaust-gas aftertreatment system for the aftertreatment of the exhaust gas.

To reduce (e.g., minimize) the soot emissions, use is in this case may be made of a regenerative particle filter which filters the soot particles out of the exhaust gas and stores them, with said soot particles being burned off intermittently during the course of the regeneration of the filter. The temperatures needed for the regeneration of the particle filter may be approximately 550° C. in the absence of catalytic assistance, in one example. Therefore, additional measures may generally be implemented in order to ensure a regeneration of the filter under all operating conditions.

The regeneration of the filter introduces heat into the exhaust gas and increases the exhaust-gas temperature and thus the exhaust-gas enthalpy. An energy-rich exhaust gas is thus available at the outlet of the filter, which exhaust gas can be utilized in the manner described herein.

Embodiments of the supercharged internal combustion engine may also be advantageous in which an oxidation catalytic converter is provided as exhaust-gas aftertreatment system for the aftertreatment of the exhaust gas.

Even without additional measures, oxidation of the unburned hydrocarbons and of carbon monoxide duly takes place in the exhaust-gas discharge system at a sufficiently high temperature level and in the presence of sufficiently large oxygen quantities. However, on account of the exhaust-gas temperature falling quickly in the downstream direction, and the rapidly decreasing rate of reaction, said reactions may be quickly halted. Therefore, use may be made of catalytic reactors which, using catalytic materials, ensure an oxidation even at low temperatures. If nitrogen oxides are additionally to be reduced, this may, in the case of the Otto-cycle engine, be achieved through the use of a three-way catalytic converter.

The oxidation may be an exothermic reaction, wherein the heat that is released increases the temperature and thus the enthalpy of the exhaust gas. A more energy-rich exhaust gas is thus available at the outlet of the oxidation catalytic converter. In this respect, the provision of an oxidation catalytic converter is expedient and advantageous in particular also with regard to the utilization of the exhaust-gas energy by the engine described herein.

To reduce the nitrogen oxides, use may be made of selective catalytic converters in which reducing agent is purposely introduced into the exhaust gas in order to selectively reduce the nitrogen oxides. As reducing agent, in addition to ammonia and urea, use may also be made of unburned hydrocarbons.

The nitrogen oxide emissions may also be reduced by means of storage catalytic converters. Here, the nitrogen oxides are initially, during lean-burn operation of the internal combustion engine, absorbed, that is to say collected and stored, in the catalytic converter before being released and reduced during a regeneration phase, for example, by way of substoichiometric operation of the internal combustion engine with a deficit of oxygen.

The sulfur contained in the exhaust gas is likewise absorbed in the storage catalytic converter and must be regularly removed in the course of so-called desulfurization. Temperatures of between 600° C. and 700° C. may be needed for this purpose.

Embodiments of the internal combustion engine may therefore also be advantageous in which a storage catalytic converter is provided as exhaust-gas aftertreatment system for the aftertreatment of the exhaust gas.

Embodiments of the internal combustion engine may be advantageous in which a bypass line for circumventing the cooler is provided, which bypass line bypasses the EGR cooler and by means of which bypass line the exhaust gas that is recirculated via the exhaust-gas recirculation arrangement can be introduced, circumventing the cooler, into the intake system.

It may be expedient, in some examples, to bypass the EGR cooler in order to prevent heat from additionally being introduced into the liquid-type cooling arrangement of the internal combustion engine. Such an approach is expedient if the liquid-type cooling arrangement of the internal combustion engine is already highly loaded, for example in full-load situations. If the exhaust-gas recirculation arrangement is utilized during the course of engine braking, it may be likewise expedient for the hot exhaust gas to be recirculated without being cooled.

Embodiments of the internal combustion engine may also be advantageous in which a liquid-type cooling arrangement is provided for forming an engine cooling system.

Embodiments of the internal combustion engine may also be advantageous in which the at least one cylinder head of the internal combustion engine is provided with at least one coolant jacket, which is integrated in the cylinder head, in order to form a liquid-type cooling arrangement.

A liquid-type cooling arrangement has proven to be advantageous in particular in the case of supercharged engines because the thermal loading of supercharged engines is considerably higher than that of conventional internal combustion engines. If the cylinder head has an integrated exhaust manifold, said cylinder head is thermally more highly loaded than a conventional cylinder head which is equipped with an external manifold, increased demands are placed on the cooling arrangement.

In this context, embodiments of the internal combustion engine may be advantageous in which the liquid-type cooling arrangement has a cooling circuit which includes the cooler.

If the EGR cooler is incorporated into the cooling circuit of the engine cooling system, numerous components and assemblies needed to form a circuit may only need to be provided once, as these may be used both for the cooling circuit of the EGR cooler and also for that of the engine cooling system, which leads to synergies and cost savings, but also entails a weight saving.

For example, it may be desirable for only one pump for conveying the coolant, and one container for storing the coolant, to be provided. The heat dissipated to the coolant from the internal combustion engine and in the EGR cooler can be extracted from the coolant in a common heat exchanger.

The exhaust-gas energy or exhaust-gas heat that is absorbed by the coolant in the EGR cooler can thus likewise be utilized more easily, for example for warming the internal combustion engine or the engine oil.

A method for operating an internal combustion engine of a type described above, is also described herein. The method includes deactivating an exhaust-gas recirculation arrangement by closing the shut-off element and adjusting the volume provided for the exhaust gas to increase (e.g., maximize) the heat transfer from the exhaust gas into the coolant of the cooler.

That which has already been stated with regard to the internal combustion engine may also apply to the method described herein. Different embodiments of the internal combustion engine may require correspondingly different method variants, in which regard reference is made to the corresponding statements.

Method variants may be advantageous in which the engine speed $n_{mot}$ of the internal combustion engine is taken into consideration in the setting of the volume.

The engine speed $n_{mot}$ of the internal combustion engine has a direct influence on the dynamic wave phenomena occurring in the exhaust-gas discharge system and thus on the heat transfer in the EGR cooler.

Method variants may also be advantageous in which the shut-off element of the exhaust-gas recirculation arrangement is closed in the warm-up phase or after a cold start of the internal combustion engine.

In particular after a cold start of the internal combustion engine, a demand exists for warming the engine oil and the internal combustion engine in a targeted fashion. Owing to the arrangement of the shut-off element in the exhaust-gas recirculation system, the hot exhaust gas may be utilized even when the exhaust-gas recirculation arrangement has been deactivated.

That is to say, despite the exhaust-gas recirculation arrangement having been deactivated in the warm-up phase, heat can be transferred from the exhaust gas to the coolant. The coolant flowing through the coolant jacket dissipates the heat from the interior of the cooler and may supply it to other engine components.

FIG. 1 schematically shows an example of an internal combustion engine 1 together with an exhaust-gas recirculation arrangement 4. The exhaust-gas recirculation arrangement may be an exhaust-gas recirculation (EGR) system, in some examples.

The internal combustion engine 1 has an intake system 3 for supplying charge air to the cylinders and has an exhaust-gas discharge system 2 for discharging the exhaust gases from the cylinders. The exhaust-gas discharge system 2 may be referred to as an exhaust system.

For the purposes of supercharging, the internal combustion engine 1 is equipped with an exhaust-gas turbocharger 6 which includes a turbine 6*b* arranged in the exhaust-gas discharge system 2 and a compressor 6*a* arranged in the intake system 3.

However, in other examples the compressor 6*a* may be driven by an auxiliary drive 50. The auxiliary drive 50 may include an energy storage device 52 and an electric motor 54. The energy storage device 52 may be designed to provide power to the electric motor 54 as well as gather energy from the engine 1, using, for example, a regenerative braking system.

Furthermore, an exhaust-gas recirculation arrangement 4 is provided in the engine 1. The exhaust-gas recirculation arrangement 4 may be referred to as an EGR system, in some examples. The exhaust-gas recirculation arrangement 4 has a recirculation line 4*a* that branches off from the exhaust-gas discharge system 2 downstream of the turbine 6*b*, so as to form a first junction point 2*a*, and which opens into the intake system 3 upstream of the compressor 6*a*, so as to form a second junction point 3*a*. In the recirculation line 4*a* there is arranged a cooler 5 (e.g., EGR cooler) which has a coolant-conducting coolant jacket 5*a* which is configured to enable the transfer of heat between the exhaust gas and the coolant. The recirculation line 4*a* may be an EGR conduit, in one example. The coolant jacket 5*a* is designed to route coolant around exhaust gas flowing through the cooler. The cooler 5 and specifically the coolant jacket 5*a* includes an inlet port 20 receiving coolant from a first coolant conduit 26 and outlet port 22 expelling coolant into a second coolant conduit 28. As shown, the coolant flowing into and out of the coolant jacket 5*a* is provided by an engine cooling system 23 including a heat exchanger 24 (e.g., radiator) and a pump 25. The heat exchanger 24 is configured to remove heat from coolant flowing therethrough and the pump is configured to circulate coolant through the engine cooling system 23 and the cooler 5. Additionally or alternatively, coolant from the cooler 5 may be directed to an engine lubrication system to heat engine oil flowing through the system during a cold start, for instance. In other examples, heat from the cooler 5 may be directed to a cabin heating arrangement, to provide cabin heating.

The first coolant conduit 26 extends between the inlet port 20 and a first junction 27 and the second coolant conduit 28 extend between the outlet port 22 and a second junction 29. The coolant conduits provide fluidic communication between the components to which they are coupled.

Valves (e.g., three-way valves) may be included in the first junction 27 and/or second junction 29 and are designed to regulate the amount of coolant provide to each of the conduits at the junctions. For instance, the valves in the first and/or second junctions may be adjust to direct coolant flow through both the engine cooling system 23 and the exhaust-gas recirculation arrangement 4. Specifically, in one example, coolant heated by the exhaust gas flowing through the cooler 5 may be routed directly to a coolant conduit 36 (e.g., coolant jacket) traversing the engine 1 without flowing through the heat exchanger 24 to heat the engine during a cold start, for instance. However, during other conditions, coolant heated by the exhaust gas flowing through the cooler 5 may be routed directly to the heat exchanger 24 without traveling through coolant conduit 36 in the engine. In other examples, the valves in the first and/or second junctions may be adjusted to direct coolant solely through the engine cooling system 23 or solely through the exhaust-gas recirculation arrangement 4. In yet other examples, the cooler 5 may include a dedicated heat exchanger (e.g., radiator) and pump which are separate from the heat exchanger and pump used by the engine cooling system 23. Still further in other examples, coolant from the cooler 5 may be directed through coolant lines in the heat exchanger 24 that are separate from coolant lines receiving coolant from the engine cooling system 23. In such an example, coolant may be routed through the separate coolant lines in the heat exchanger 24 in parallel.

Additionally, a bypass line 38 may be coupled upstream and downstream of the cooler 5 to enable exhaust gas to bypass the cooler. A bypass valve 39 may be positioned in the bypass line 38 and is configured to adjust (e.g., increase or decrease) exhaust gas flow therethrough.

A shut-off element 4*b* arranged in the recirculation line 4*a* downstream of the cooler 5 is configured to set (e.g., increase or decrease) the recirculated exhaust-gas flow rate, that is to say of the recirculation rate, and thus also for the deactivation of the exhaust-gas recirculation arrangement 4. For instance, the shut-off element 4*b* may be designed to block exhaust gas recirculation flow during selected operating conditions while permitting exhaust gas recirculation flow during other selected operating conditions. Thus, the shut-off element 4*b* may be an EGR valve designed to adjust the flowrate of the exhaust gas traveling through the recirculation line 4*a*. Examples of the EGR valve include a rotary valve, a butterfly valve, and/or any other suitable valve that functions to regulate EGR flow.

When the exhaust-gas recirculation arrangement 4 is active, the cooler 5 reduces the temperature in the hot exhaust gas for recirculation before the recirculated exhaust gas is mixed, in the intake system 3, with fresh air. A throttle 3*b* is arranged in the intake system 3 upstream of the second junction point 3*a*, by means of which throttle it is possible inter alia to influence the driving pressure gradient between the exhaust-gas discharge system 2 and the intake system 3.

The illustrated exhaust-gas recirculation arrangement 4 is distinguished by the fact that the volume 7 provided for the exhaust gas between the first junction point 2*a* or the cooler 5 and the closed shut-off element 4*b*, which volume is of coherent form and is open toward the exhaust-gas discharge system 2, is variable. In the present case, a vessel 7*a* (e.g., variable volume vessel) is provided which is connectable to the recirculation line 4*a* and which is variable in volume. The vessel 7*a* therefore opens into the recirculation line 4*a*. Specifically, the vessel 7*a* opens into recirculation line 4*a* downstream of the cooler 5 and upstream of the shut-off element 4*b*.

The vessel 7*a* includes a volume adjustment device 30 and an actuator 32. The volume adjustment device 30 may be a piston and the actuator 32 may be a solenoid valve, in one example. However, other volume adjustment devices have been contemplated, such as an adjustable length conduit that increases and decreases in length in a telescopic manner. In other examples, the volume adjustment device may include rotational or foldable components to enable the volume in the device to be varied. The exhaust-gas volume which is adjustable in this way can be adapted to different operating states of the internal combustion engine 1, in particular to different engine speeds $n_{mot}$, in order to adapt the volume, which is accessible to exhaust gas, of the deactivated exhaust-gas recirculation arrangement 4 to the dynamic wave phenomena in the exhaust-gas discharge system 2 and increase (e.g., optimize) the heat transfer in the EGR cooler, in some examples.

FIG. 1 also shows a controller 100 in the engine 1. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 1. The sensors may include engine coolant temperature sensor 120, exhaust gas sensors 122, an intake airflow sensor 124, etc. Additionally, the controller 100 is also configured to receive throttle position (TP) from a throttle position sensor 112 coupled to a pedal 114 actuated by an operator 116.

Additionally, the controller 100 may be configured to trigger one or more actuators and/or send commands to components. For instance, the controller 100 may trigger adjustment of the exhaust-gas recirculation arrangement 4, the throttle 3*b*, the shut-off element 4*b*, pump 25, bypass valve 39, vessel 7*a* (e.g., actuator 32 and/or volume adjustment device 30), auxiliary drive 50, and/or valves included in the first junction 27 and/or the second junction 29.

For example, adjusting the vessel 7*a* may include adjusting an actuator to adjust the volume in the vessel. In yet another example, the amount of volume adjustment in the vessel may be empirically determined and stored in predetermined lookup tables or functions. For example, one table may correspond to determining an amount of volume adjustment in the vessel while EGR operation is suspended and another table may correspond to determining an amount of volume adjustment in the vessel while EGR operation is occurring.

Figure 2:
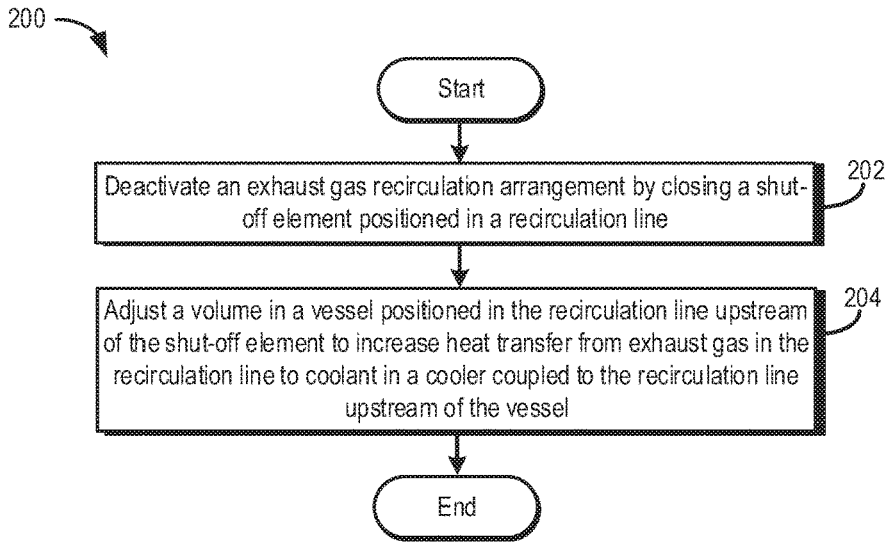
FIGS. 2-3 show methods for controlling an internal combustion engine and exhaust-gas recirculation arrangement.

FIG. 2 shows a method 200 for operating an internal combustion engine. The method 200, as well as the other methods described herein, may be implemented by the internal combustion engine, engine systems, and engine components, described above with regard to FIG. 1, or may be implemented by other suitable internal combustion engines, engine systems, and engine components, in other embodiments. Furthermore, the method 200, as well as the other methods described herein, may be stored as instructions in non-transitory memory executable by a processor, in one example. Moreover, it will be appreciated that the instructions described in the method 200, as well as the other methods described below, may trigger actuators in the engine and EGR system.

At 202 the method includes deactivating an exhaust gas recirculation arrangement by closing a shut-off element positioned in a recirculation line. In this way, exhaust gas flow may be inhibited through the EGR system. It will be appreciated that EGR may be deactivated when the engine speed and/or engine temperature is below a threshold value. The threshold engine temperature may be between 100 and 200 degrees Fahrenheit (F.) and the threshold engine speed may be 2,000-5,000 revolutions per minute (RPM). However, numerous threshold engine speeds and temperatures have been contemplated.

Next at 204 the method includes adjusting a volume in a vessel positioned in the recirculation line upstream of the shut-off element to increase heat transfer from exhaust gas in the recirculation line to coolant in a cooler coupled to the recirculation line upstream of the vessel. Thus, the volume in the vessel may be tuned to increase and reinforce pressure wave propagation through the EGR system to increase the amount of heat transferred to the EGR cooler. In this way, energy can be extracted from the cooler even when exhaust gas is not routed through the EGR system.

In one example, engine speed of the internal combustion engine is taken into consideration when adjusting the volume in the vessel. For instance, when the engine speed is increased the volume in the vessel may be increased or vice-versa. On the other hand, in some examples, when the engine speed is decreased the volume in the vessel may be decreased or vice versa. Further in other examples, the volume in the vessel may be adjusted to decrease heat transfer from the exhaust gas in the recirculation line to the cooler. For instance, engine heating may not be needed during certain operating conditions. Thus, in such an example, the volume in the vessel may be tuned to dampen pressure wave propagation through the EGR system and specifically the cooler. The pressure wave may be dampened by the vessel when it is not desirable to gather additional energy from the EGR cooler.

Figure 3:
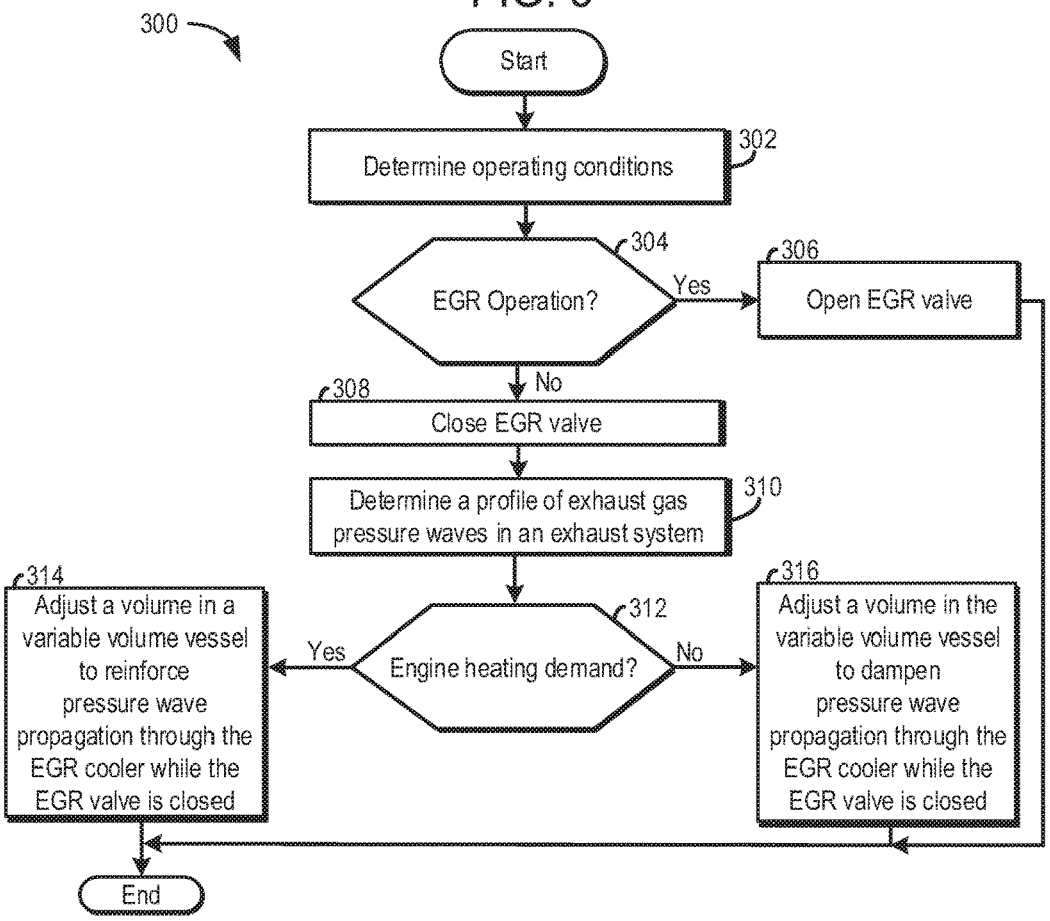

FIG. 3 shows a method 300 for operating an internal combustion engine and EGR system. At 302, the method includes determining engine operating conditions. The engine operating conditions may include engine speed, engine load, valve timing, engine temperature, exhaust gas pressure, exhaust gas flowrate, etc.

Next at 304 the method includes determining if EGR operation should be implemented in an EGR system. Determining if EGR operation should be implemented may be based on engine temperature, engine speed, exhaust gas composition, etc. For instance, EGR operation may be implemented when the engine speed is greater than a threshold value (e.g., 2,000-3,000 RPM). It will be appreciated that the aforementioned threshold value may change based on engine operating conditions, in some examples. Moreover, numerous engine speed threshold values have been contemplated.

If it is determined that EGR operation should be implemented (YES at 304) the method advances to 306. At 306 the method includes opening an EGR valve.

However, if it is determined that EGR operation should not be implemented (NO at 304) the method proceeds to 308. At 308 the method includes closing the EGR valve. Next at 310 the method includes determining a profile (e.g., frequency and magnitude) of exhaust gas pressure waves in an exhaust system. The profile of the exhaust pressure waves may be determined based on engine speed, valve timing, engine temperature, etc. Specifically in one example, engine speed may be directly correlated to the frequency and magnitude of pressure waves in the exhaust system.

At 312 the method includes determining if there is a heating demand in the engine. The engine heating demand may be determined based on a threshold temperature (e.g., 50-100 degrees F.). However, numerous threshold temperatures have been contemplated. In one example, there may be an engine heating demand when the engine is below a threshold temperature (e.g., threshold cold start temperature). Conversely, a heating demand may not exist when the engine is above the threshold temperature.

If it is determined that there is an engine heating demand (YES at 312) the method advances to 314. At 314 the method includes adjusting a volume in a variable volume vessel to reinforce pressure wave propagation through the EGR cooler while the EGR valve is closed. In this way, the EGR cooler may be used to extract energy from exhaust gas when EGR operation is not occurring. In particular, the acoustic resonance in the EGR system can be tuned to promote pressure wave propagation through the EGR system when the EGR is closed. For instance, the pressure waves may propagate through the cooler in a downstream direction and then bounce off the EGR valve and travel back through the cooler in an upstream direction before being reintroduced into an exhaust conduit. In some examples, the energy extracted from the EGR cooler may be used to heat engine coolant, heat engine oil, heat an engine cabin, and/or may be direct to other suitable systems that have heating needs. In this way, engine efficiency can be increased.

Further in one example, an amount of coolant delivered to the EGR cooler may be increased in response to adjusting the volume in the variable volume vessel to reinforce pressure wave propagation through the EGR cooler.

On the other hand, if it is determined that there is not a demand for engine heating (NO at 312) the method proceeds to 316. At 316 the method includes adjusting a volume in the variable volume vessel to dampen pressure wave propagation through the EGR cooler while the EGR valve is closed. In this way, the variable volume vessel may be tuned to reduce the amount of heat transferred to the cooler when heat extraction from the exhaust gas is not desirable. For instance, it may not be desirable to extract heat through the EGR cooler when the engine temperature is above a threshold value (e.g., 170-200 degrees Fahrenheit (F.)). Further in one example, an amount of coolant delivered to the EGR cooler may be decreased in response to adjusting the volume in the variable volume vessel to dampen pressure wave propagation through the EGR cooler.

Further in other examples, both the coolant delivered to the EGR cooler and the pressure wave propagation through the EGR cooler controlled by the variable volume vessel may be controlled in tandem. For instance, pressure wave propagation through the EGR cooler may be reinforced through an adjustment in the volume in the vessel based on engine speed while an increased amount of coolant is flowed through the EGR cooler. However, when the engine reaches a threshold temperature (e.g., 170-200 degrees F.) the coolant delivered to the EGR cooler may be decreased. Additionally or alternatively, when the engine reaches a threshold temperature the amount of pressure wave propagation through the EGR cooler may be dampened through an adjustment of the volume in the variable volume vessel. In this way, the EGR system may be tuned to generate pressure wave cancellation.

The invention will further be described in the following paragraphs. In one aspect, an internal combustion engine is provided. The internal combustion engine includes at least one cylinder, an intake system for supplying charge air to the at least one cylinder, an exhaust-gas discharge system for discharging exhaust gases, and an exhaust-gas recirculation arrangement which comprises a recirculation line which branches off from the exhaust-gas discharge system so as to form a first junction point and opens into the intake system so as to form a second junction point, a cooler being provided in the recirculation line, the cooler having a coolant jacket which conducts coolant and which serves for the transfer of heat between exhaust gas and coolant, and a shut-off element being arranged in the recirculation line downstream of the cooler, where a volume provided for exhaust gas between the first junction point and the shut-off element of the exhaust-gas recirculation arrangement is variable, said volume being of coherent form and being open toward the exhaust-gas discharge system.

In another aspect, a method for operating an internal combustion engine is provided. The method includes deactivating an exhaust gas recirculation arrangement by closing a shut-off element positioned in a recirculation line and adjusting a volume in a vessel positioned in the recirculation line upstream of the shut-off element to increase heat transfer from exhaust gas in the recirculation line to coolant in a cooler coupled to the recirculation line upstream of the vessel.

In yet another aspect, a method for operating an internal combustion engine is provided. The method includes closing an EGR valve positioned in an exhaust gas recirculation (EGR) conduit downstream of an EGR cooler, the EGR conduit coupled to an intake system and an exhaust system, determining a profile of exhaust pressure waves in the exhaust system, and adjusting a volume of variable volume vessel based on the profile of the exhaust pressure waves, the variable volume vessel positioned downstream of the EGR cooler and upstream of the EGR valve.

In any of the aspects herein or combinations of the aspects, the volume provided for exhaust gas between the first junction point and the shut-off element of the exhaust-gas recirculation arrangement may include at least one vessel which is connected to the recirculation line.

In any of the aspects herein or combinations of the aspects, the at least one vessel may be of variable volume.

In any of the aspects herein or combinations of the aspects, the internal combustion engine may further include at least one compressor which can be driven by means of an auxiliary drive is arranged in the intake system.

In any of the aspects herein or combinations of the aspects, the internal combustion engine may further include at least one exhaust-gas turbocharger including a turbine arranged in the exhaust-gas discharge system and a compressor arranged in the intake system.

In any of the aspects herein or combinations of the aspects, the recirculation line may open into the intake system downstream of the compressor so as to form the second junction point.

In any of the aspects herein or combinations of the aspects, at least one exhaust-gas aftertreatment system may be provided in the exhaust-gas discharge system between the turbine and the first junction point.

In any of the aspects herein or combinations of the aspects, the internal combustion engine may further include a bypass line is provided for circumventing the cooler.

In any of the aspects herein or combinations of the aspects, the internal combustion engine may further include a liquid-type cooling arrangement forming an engine cooling system.

In any of the aspects herein or combinations of the aspects, the liquid-type cooling arrangement may have a cooling circuit which comprises the cooler of the exhaust-gas recirculation arrangement.

In any of the aspects herein or combinations of the aspects, engine speed of the internal combustion engine may be taken into consideration in adjusting the volume in the vessel.

In any of the aspects herein or combinations of the aspects, the volume of the variable volume vessel may be adjusted to reinforce pressure wave propagation through the EGR cooler while the EGR valve is closed.

In any of the aspects herein or combinations of the aspects, the volume of the variable volume vessel may be adjusted to reinforce pressure wave propagation when there is demand for engine heating.

In any of the aspects herein or combinations of the aspects, the method may further include increasing a flow-rate of coolant provided to the EGR cooler in response to adjusting the volume of the variable volume vessel.

In any of the aspects herein or combinations of the aspects, the volume of the variable volume vessel may be adjusted to dampen pressure wave propagation through the EGR cooler while the EGR valve is closed.

In any of the aspects herein or combinations of the aspects, the volume of the variable volume vessel may be adjusted to dampen pressure wave propagation when there is no demand for engine heating.

In any of the aspects herein or combinations of the aspects, the EGR valve may be closed when at least one of engine speed and engine temperature is below a threshold value.

In any of the aspects herein or combinations of the aspects, the profile of the exhaust pressure waves may be determined based on at least one of engine speed, engine temperature, and valve timing.

In any of the aspects herein or combinations of the aspects, a particle filter may be provided as exhaust-gas aftertreatment system for the aftertreatment of the exhaust gas.

In any of the aspects herein or combinations of the aspects, an oxidation catalytic converter may be provided as exhaust-gas aftertreatment system for the aftertreatment of the exhaust gas.

In any of the aspects herein or combinations of the aspects, the recirculation line may open into the intake system upstream of the compressor so as to form the second junction point.

In any of the aspects herein or combinations of the aspects, the recirculation line may branch off from the exhaust-gas discharge system upstream of the turbine so as to form the first junction point.

In any of the aspects herein or combinations of the aspects, the recirculation line may branch off from the exhaust-gas discharge system downstream of the turbine so as to form the first junction point.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine comprising:

at least one cylinder;

an intake system for supplying charge air to the at least one cylinder;

an exhaust-gas discharge system for discharging exhaust gases; and an exhaust-gas recirculation arrangement which comprises a recirculation line which branches off from the exhaust-gas discharge system so as to form a first junction point and opens into the intake system so as to form a second junction point, a cooler being provided in the recirculation line, the cooler having a coolant jacket which conducts coolant and which serves for the transfer of heat between exhaust gas and coolant, and a shut-off element being arranged in the recirculation line downstream of the cooler;

where a volume provided for exhaust gas between the first junction point and the shut-off element of the exhaust-gas recirculation arrangement is variable, said volume being of coherent form and being open toward the exhaust-gas discharge system.

2. The internal combustion engine of claim 1, where the volume provided for exhaust gas between the first junction point and the shut-off element of the exhaust-gas recirculation arrangement comprises at least one vessel which is connected to the recirculation line.

3. The internal combustion engine of claim 2, where the at least one vessel is of variable volume.

4. The internal combustion engine of claim 1, further comprising at least one compressor which can be driven by means of an auxiliary drive is arranged in the intake system.

5. The internal combustion engine of claim 1, further comprising at least one exhaust-gas turbocharger including a turbine arranged in the exhaust-gas discharge system and a compressor arranged in the intake system.

6. The internal combustion engine of claim 5, where the recirculation line opens into the intake system downstream of the compressor so as to form the second junction point.

7. The internal combustion engine of claim 5, where at least one exhaust-gas aftertreatment system is provided in the exhaust-gas discharge system between the turbine and the first junction point.

8. The internal combustion engine of claim 1, further comprising a bypass line is provided for circumventing the cooler.

9. The internal combustion engine of claim 1, further comprising a liquid-type cooling arrangement forming an engine cooling system.

10. The internal combustion engine of claim 9, where the liquid-type cooling arrangement has a cooling circuit which comprises the cooler of the exhaust-gas recirculation arrangement.

11. A method for operating an internal combustion engine comprising:

deactivating an exhaust gas recirculation arrangement by closing a shut-off element positioned in a recirculation line; and adjusting a volume in a vessel positioned in the recirculation line upstream of the shut-off element to increase heat transfer from exhaust gas in the recirculation line to coolant in a cooler coupled to the recirculation line upstream of the vessel.

12. The method of claim 11, where engine speed of the internal combustion engine is taken into consideration in adjusting the volume in the vessel.

13. A method for operating an internal combustion engine comprising:

closing an EGR valve positioned in an exhaust gas recirculation (EGR) conduit downstream of an EGR cooler, the EGR conduit coupled to an intake system and an exhaust system;

determining a profile of exhaust pressure waves in the exhaust system; and adjusting a volume of variable volume vessel based on the profile of the exhaust pressure waves, the variable volume vessel positioned downstream of the EGR cooler and upstream of the EGR valve.

14. The method of claim 13, where the volume of the variable volume vessel is adjusted to reinforce pressure wave propagation through the EGR cooler while the EGR valve is closed.

15. The method of claim 14, where the volume of the variable volume vessel is adjusted to reinforce pressure wave propagation when there is demand for engine heating.

16. The method of claim 15, further comprising increasing a flowrate of coolant provided to the EGR cooler in response to adjusting the volume of the variable volume vessel.

17. The method of claim 13, where the volume of the variable volume vessel is adjusted to dampen pressure wave propagation through the EGR cooler while the EGR valve is closed.

18. The method of claim 17, where the volume of the variable volume vessel is adjusted to dampen pressure wave propagation when there is no demand for engine heating.

19. The method of claim 13, where the EGR valve is closed when at least one of engine speed and engine temperature is below a threshold value.

20. The method of claim 13, where the profile of the exhaust pressure waves is determined based on at least one of engine speed, engine temperature, and valve timing.

* * * * *